US006946632B2

(12) United States Patent
Shon et al.

(10) Patent No.: US 6,946,632 B2
(45) Date of Patent: Sep. 20, 2005

(54) COOKING APPARATUS EQUIPPED WITH WEIGHT MEASURING DEVICE

(75) Inventors: Jong Chull Shon, Suwon (KR); Young Hoon Kang, Suwon (KR); Han Jun Sung, Suwon (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/697,646

(22) Filed: Oct. 31, 2003

(65) Prior Publication Data

US 2004/0245245 A1 Dec. 9, 2004

(30) Foreign Application Priority Data

Jun. 5, 2003 (KR) ..... 10-2003-0036434

(51) Int. Cl.[7] ..... H05B 6/68

(52) U.S. Cl. ..... 219/708; 219/754; 219/518; 177/256; 99/325

(58) Field of Search ..... 219/708, 754, 219/518; 99/325, 451; 177/256–259

(56) References Cited

U.S. PATENT DOCUMENTS 5,430,275 A 7/1995 Braunisch 5,463,207 A * 10/1995 Kang ..... 219/708

FOREIGN PATENT DOCUMENTS

JP 61-119921 * 6/1986 ..... 126/60
JP 5-180445 * 7/1993 ..... 219/708

* cited by examiner

*Primary Examiner*—Philip H. Leung

(74) *Attorney, Agent, or Firm*—Staas & Halsey LLP

(57) ABSTRACT

A weight measuring device having a lever structure, a cooking apparatus equipped with the weight measuring device, and a mounting structure of the weight measuring device. A weight sensor pushed by a lever is disposed on an outer bottom surface of a cooking cavity. The lever is extended from the weight sensor to a lever passing hole to perform a lever action with a first end of the lever protruded to an inside of the cooking cavity through the lever passing hole, and a second end of the lever inserted into a lever receiving hole of a sensor housing that accommodates the weight sensor. The lever transmits pressure, which is generated when rollers pass over the protruded first end of the lever, to the weight sensor through the lever action.

31 Claims, 6 Drawing Sheets

COOKING APPARATUS EQUIPPED WITH WEIGHT MEASURING DEVICE

CROSS-REFERENCE TO RELATED APPLICATIONS

This application claims the benefit of Korean Application No. 2003-36434, filed Jun. 05, 2003, in the Korean Intellectual Property Office, the disclosure of which is incorporated herein by reference.

BACKGROUND OF THE INVENTION

1. Field of the Invention

The present invention relates to a cooking apparatus equipped with a weight measuring device and, more particularly, to a mounting structure of a weight sensor of a cooking apparatus that accurately measures a weight of food, and determines an appropriate cooking time using the measured weight of the food.

2. Description of the Related Art

In an automatic cooking apparatus, such as a gas oven, an electrical oven, or a microwave oven, food is automatically cooked according to a control method provided to the apparatus. Efficient use of the automatic cooking apparatus requires entry of information regarding the food, such as the kind of food or the amount of food, into the cooking apparatus in order to automatically cook the food with an appropriate amount of heating over an appropriate cooking time.

The information regarding the food is provided by a user through an input unit of the automatic cooking apparatus. As described above, when the information regarding the food is manually input by the user, the user needs to use a separate weight measuring device to accurately measure the amount of food that requires cooking. If the user roughly estimates the amount of food and enters the roughly estimated amount of food into the automatic cooking apparatus that is not equipped with the separate weight measuring device, a discrepancy between the actual amount of food and the entered amount of food may occur resulting in an error. Due to the error, a control unit of the automatic cooking apparatus may not determine the appropriate cooking time and the appropriate amount of heating required to cook the food, thus, resulting in a reduced cooking quality.

SUMMARY OF THE INVENTION

Accordingly, it is an aspect of the present invention to provide a cooking apparatus, in which a mounting structure of a weight sensor to accurately and automatically measure a weight of food is improved, thereby, preventing the weight sensor from being contaminated by the food.

Additional aspects and advantages of the invention will be set forth in part in the description which follows and, in part, will be obvious from the description, or may be learned by practice of the invention.

The foregoing and/or other aspects and advantages of the present invention are achieved by providing a cooking apparatus including a cooking cavity provided with a lever passing hole in an outer bottom surface of the cooking cavity, a weight sensor disposed under the cooking cavity, and a lever positioned between the weight sensor and the lever passing hole so that the lever is pushed by food placed in the cooking cavity and transmits pressure to the weight sensor through a lever action.

The foregoing and/or other aspects and advantages of the present invention are achieved by providing a cooking apparatus including a cooking cavity provided with rollers that are brought into rolling contact with a tray, which holds food and is rotatable, and a bottom surface of the cooling cavity to be rotated together with the tray when the tray is rotated, a weight sensor positioned under the cooking cavity, and a lever positioned between the weight sensor and a position of a track of the rollers to transmit pressure applied by the rollers to the weight sensor through a lever action.

The foregoing and/or other aspects and advantages of the present invention are achieved by providing a cooking apparatus including a cooking cavity provided with at least one positioning elements formed on an outer bottom surface of the cooking cavity, a weight sensor adapted to generate an electrical signal corresponding to a weight of food placed in the cooking cavity, a sensor housing positioned under the cooking cavity to accommodate the weight sensor, a mounting position of the sensor housing being determined by the positioning elements, and a bracket adapted to fix the sensor housing, whose mounting position is determined, on the outer bottom surface of the cooking cavity.

BRIEF DESCRIPTION OF THE DRAWINGS

The above and/or other aspects and advantages of the invention will become apparent, and more readily appreciated from the following description of the preferred embodiments, taken in conjunction with the accompanying drawings of which.

DETAILED DESCRIPTION OF THE PREFERRED EMBODIMENTS

Figure 1:
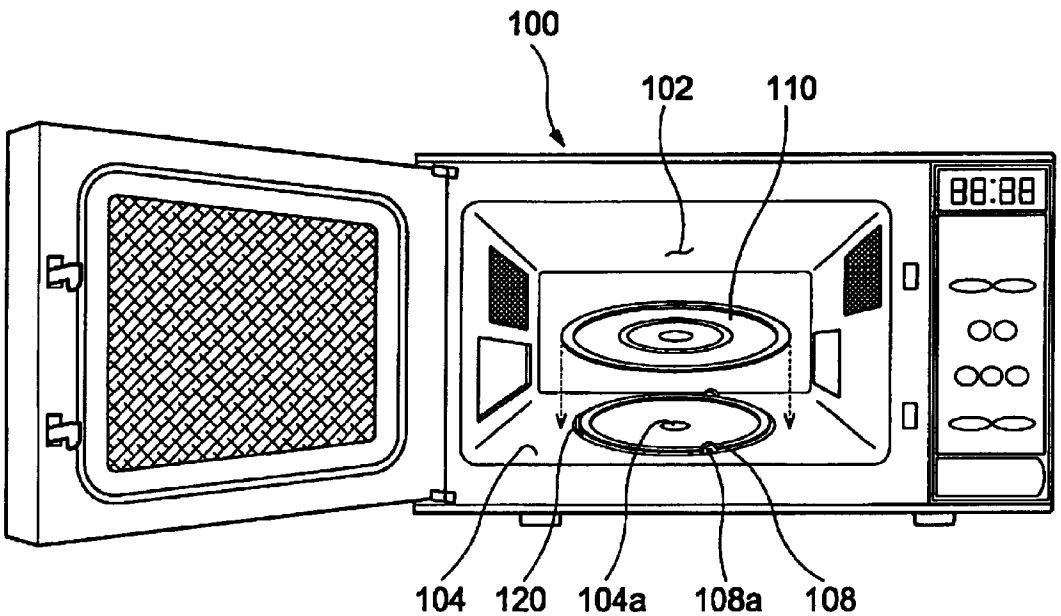
FIG. 1 is a perspective view of a microwave oven, according to an aspect of the present invention.

Reference will now be made in detail to the present preferred embodiments of the present invention, examples of which are illustrated in the accompanying drawings, wherein like reference numerals refer to like elements throughout.

Hereinafter, a cooking apparatus will be described with reference to FIGS. 1 through 6, according to various aspects of the present invention. FIG. 1 is a perspective view of a microwave oven, according to an aspect of the present invention. As shown in FIG. 1, within a cooking cavity 102 of a microwave oven 100 of the present invention, a tray 110 is provided to allow food to be laid thereon and to be rotated. A tray motor (not shown) is disposed under the cooking cavity 102 to rotate the tray 110. The tray motor is mechanically connected to the tray 110 via a rotating shaft 104*a*, and is rotated together with the tray 110. A ring-shaped roller supporting member 108 is disposed on a bottom 104 of the cooking cavity 102. Rollers 108*a* are mounted on the roller supporting member 108 to be rotatable. The tray 110 is put on the rollers 108*a*, and is smoothly rotated together with the rotating shaft 104*a* on the bottom 104 of the cooking cavity 102 without a tilt or movement with an aid of operations of the roller supporting member 108 and the rollers 108*a*. A first end 120 of a lever (see FIG. 5) to transmit pressure to a weight sensor (see FIG. 2) is protruded through a track along which the rollers 108*a* move on the bottom 104 of the cooking cavity 102.

Figure 2:
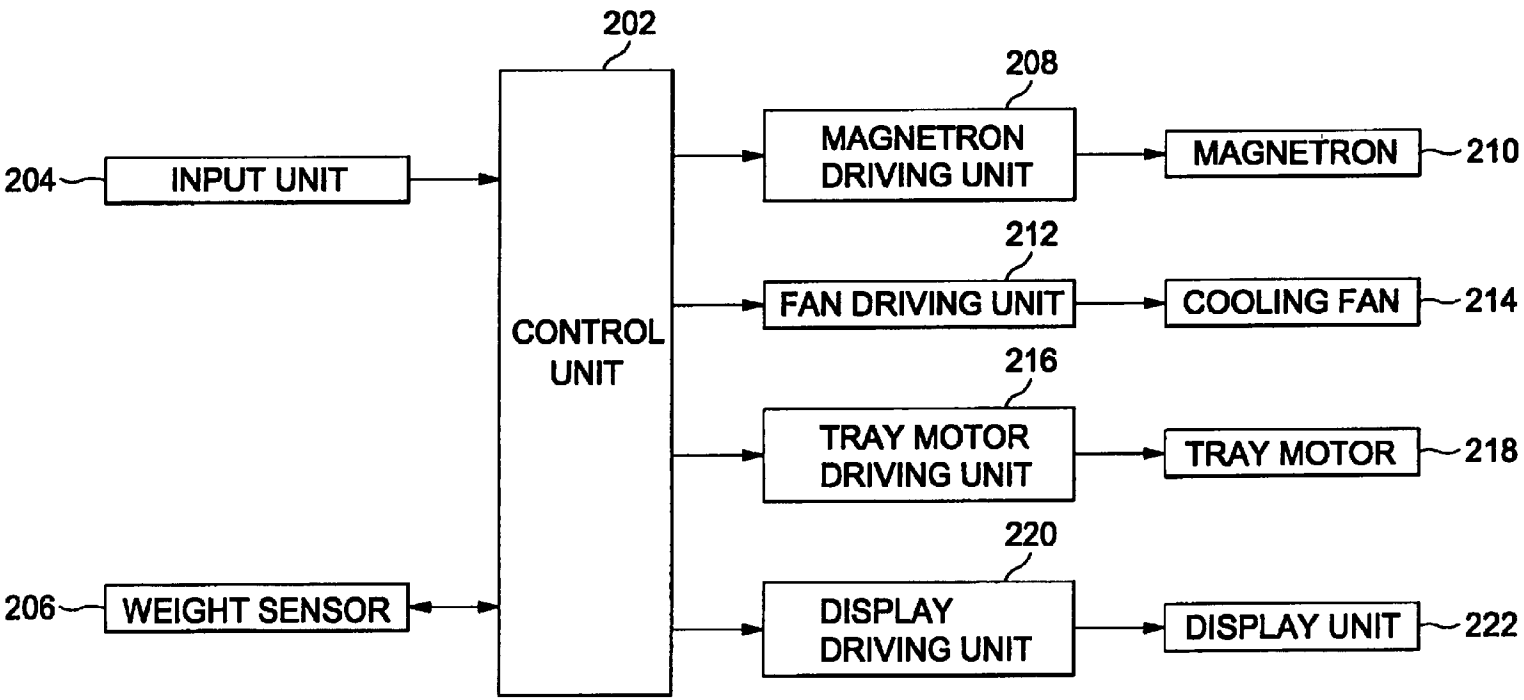
FIG. 2 is a block diagram to show a control system of the microwave oven of FIG. 1, according to an aspect of the present invention.

FIG. 2 is a block diagram to show a control system of the microwave oven 100 of FIG. 1 according to an aspect of the present invention. As shown in FIG. 2, a control unit 202 that controls an overall operation of the microwave oven 100 is connected at input terminals thereof to an input unit 204 and a weight sensor 206. The input unit 204 is provided with a cooking mode setting button (not shown) and numeral buttons (not shown) to allow a user to input cooking conditions. The control unit 202 is connected at output terminals thereof to a magnetron driving unit 208, a fan driving unit 212, a tray motor driving unit 216, and a display driving unit 220. The magnetron driving unit 208 drives a magnetron 210 to generate electromagnetic waves. The fan driving unit 212 drives a cooling fan 214 to cool various kinds of electric elements provided to a machine room (not shown). The tray motor driving unit 216 drives a tray motor 218 to rotate the tray 110 in the cooking cavity 102. The display driving unit 220 drives a display unit 222 to display help information required for cooking, cooking information, or currently set values.

Figure 3:
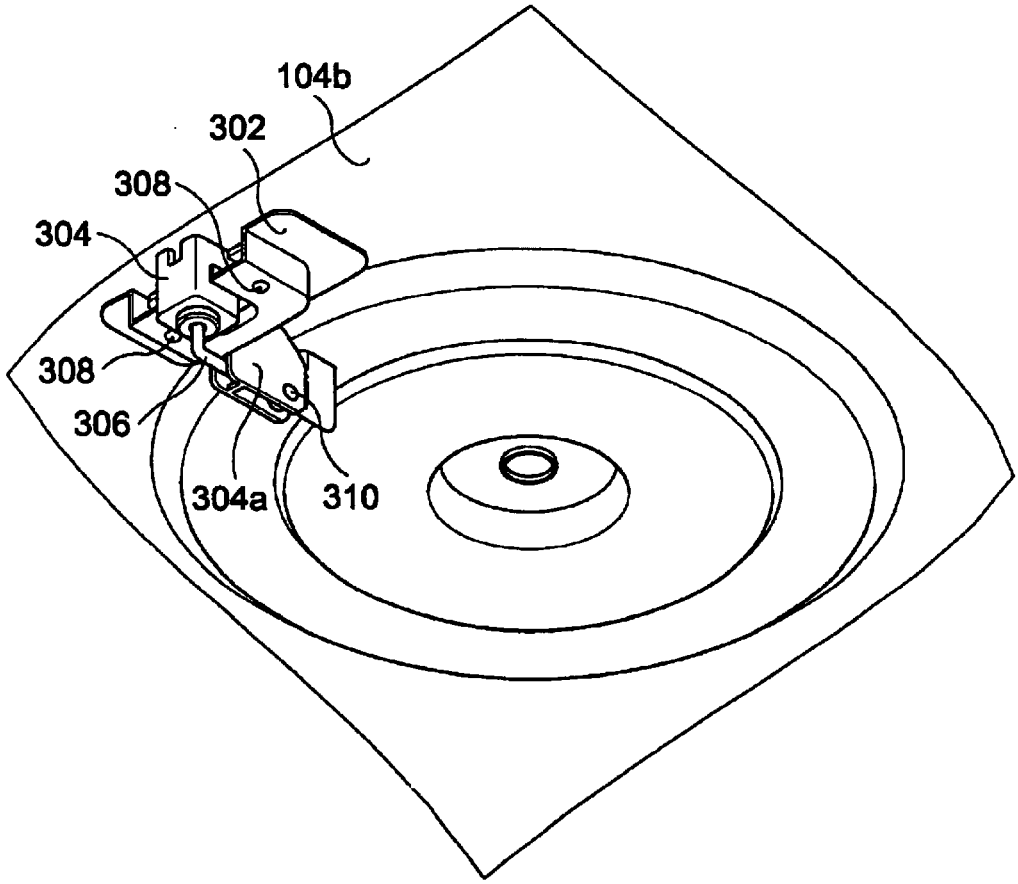
FIG. 3 is a perspective view to show a mounting structure of a weight measuring device provided to the microwave oven of FIG. 1, according to another aspect of the present invention.

FIG. 3 is a perspective view to show a mounting structure of a weight measuring device provided to the microwave oven 100 of FIG. 1, according to an aspect of the present invention. As shown in FIG. 3, the weight sensor (not shown) accommodated in a sensor housing 304 is pushed onto an outer bottom surface 104*b* of the cooking cavity 102, that is, an outer surface of the bottom 104 of the cooking cavity 102, via a lever 306. The sensor housing 304 includes a lever fastening unit 304*a*. The lever fastening unit 304*a* is fastened by a fastening member 310 to allow rotation of the lever 306. A bracket 302 is fitted onto sides of the sensor housing 304 through an opening formed in a side of the bracket 302, and fastened by fastening members 308 to secure the sensor housing 304 to the outer bottom surface 104*b* of the cooking cavity. The bracket 302 is also attached to the outer bottom surface 104*b* of the cooking cavity 102 by welding, bonding, or other suitable securing technique.

Figure 4:
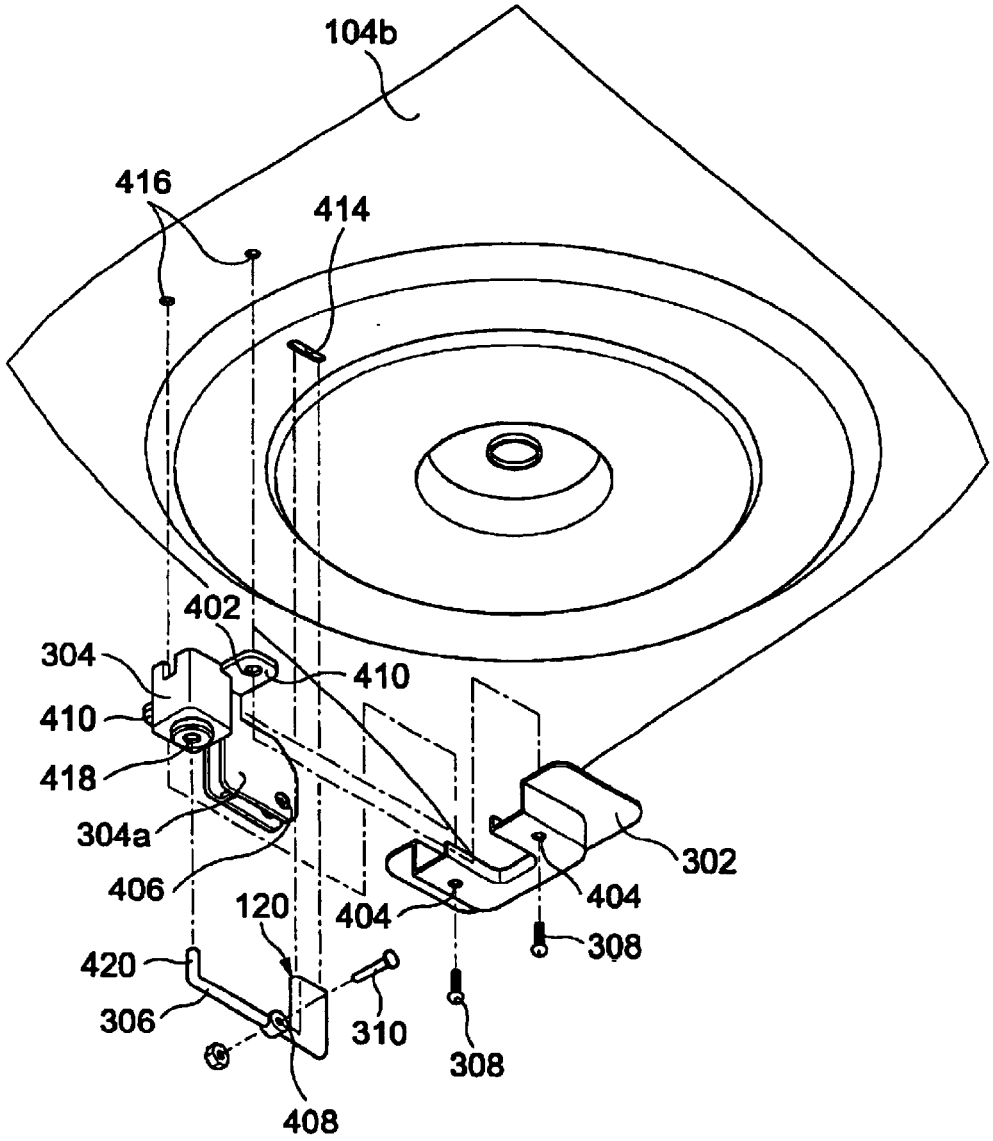
FIG. 4 is an exploded perspective view of the weight measuring device provided to the microwave oven shown in FIG. 3 according to an aspect of the present invention.

FIG. 4 is an exploded perspective view to show the weight measuring device provided to the microwave oven, shown in FIG. 3, according to an aspect of the present invention. As shown in FIG. 4, on the outer bottom surface 104*b* of the cooking cavity 102, two positioning elements 416 are formed to indicate a mounting position of the sensor housing 304, and a lever passing hole 414 is formed to allow protrusion of the end 120 of the lever 306 into an inside of the cooking cavity 102. The lever passing hole 414 is formed on the outer bottom surface 104*b* of the cooking cavity 102 on the track of the rollers 108*a*. The positioning elements 416 are used to determine accurate relative positions of the lever passing hole 414 and the sensor housing 304. The relative positions refer to positions, which allow a first end 120 of the lever 306 to be passed through the lever passing hole 414, and a second end 420 of the lever 306 to be inserted into the sensor housing 304 when the sensor housing 304 is disposed to correspond to positions of the positioning elements 416 and the lever 306 is connected to the sensor housing 304. The positioning elements 416 constitute a pair. Accordingly, because the positions of the positioning elements 416 and a position of the lever passing hole 414 form a triangle, accurate positions and directions of the sensor housing 304 and the lever 306 are established. As described above, the positioning elements 416 may be formed by punching holes in the bottom 104 of the cooking cavity 102 or by forming grooves on the outer bottom surface 104*b* of the cooking cavity 102.

The positioning elements 416 that determine the mounting position of the sensor housing 304 are spaced from the lever passing hole 414 by a predetermined distance. Since the sensor housing 304 and the lever passing hole 414 are spaced from each other, the weight sensor accommodated in the sensor housing 304 is protected from contamination even when moisture or the dregs separated from food in the cooking cavity 102 during cooking falls through the lever passing hole 414 to a space under the cooking cavity 102.

The sensor housing 304 is used to accommodate the weight sensor therein. An opening is formed on an upper portion of the sensor housing 304 to accommodate the weight sensor in the sensor housing 304 through the opening. The weight sensor 502, accommodated through the opening, is electrically connected to a separate control unit (not shown) to allow exchange of communication between the weight sensor 502 and the control unit. The sensor housing 304 is disposed on the outer bottom surface 104*b* of the cooking cavity 102 with the upper portion of the sensor housing 304 having the opening being brought into contact with the outer bottom surface 104*b* of the cooking cavity 102. A lever receiving hole 418 is formed on a portion of the sensor housing 304 opposite to the opening formed to accommodate the weight sensor 502. The second end 420 of the lever 306 is inserted into the lever receiving hole 418 and brought into contact with the weight sensor 502 accommodated in the sensor hosing 304. Two wing portions 410 are positioned at both sides of the sensor housing 304, respectively. Two protrusions (not shown), to be inserted into the positioning elements 416, are formed on the wing portions 410 that are brought into contact with the outer bottom surface 104*b* of the cooking cavity 102, respectively. Two fastening grooves 402 are formed on surfaces of the wing portions 410 opposite to surfaces of the wing portions 410 brought into contact with the outer bottom surface 104*b* of the cooking cavity 102, to allow portions of the fastening members 308 to be inserted therein. Spacing between the protrusions is the same as that of the spacing between the positioning elements 416 that are formed on the outer bottom surface 104*b* of the cooking cavity 102.

The lever fastening unit 304*a* is integrated with the sensor housing 304. The lever 306 is fastened to the lever fastening unit 304*a* to be rotated by aligning fastening holes 406 of the lever fastening unit 304*a* with a fastening hole 408 of the lever 306 and then inserting the fastening member 310 into the fastening holes 406 and 408. As a result, a portion of the level fastening unit 304*a* into which the fastening member 310 is inserted acts as a fulcrum of the lever 306.

The lever 306 is shaped similar to a rod. The first end 120 of the lever 306 is inserted through the lever passing hole 414 on the outer bottom surface 104*b* of the cooking cavity 102, and then protruded to the inside of the cooking cavity 102. The first end 120 of the lever 306 protruded to the inside of the cooking cavity 102 is pushed by the rollers 108*a* in the cooking cavity 102 so that a lever action occurs through the lever 306. The first end 120 of the lever 306 functions as a point of application of force, that is, a point where force is applied.

The second end 420 of the lever 306 functions as a point of application of the lever action that is performed when the first end 120 of the lever 306 is pushed upon by the rollers 108*a*, that is, a point to where the force is transmitted. The second end 420 of the lever 306 pushes the weight sensor accommodated in the sensor housing 304 through the lever action.

The bracket 302 is used to secure the sensor housing 304 to the outer bottom surface 104*a* of the cooking cavity 102, and is provided with a space formed by openings in one side portion and an upper portion of the bracket 302 so that the wing portions 410 of the sensor housing 304 are inserted thereinto and, therefore, brought into contact with the outer bottom surface 104*b* of the cooking cavity 102. Additionally, when the sensor housing 304 is secured by the bracket 302, the opening is formed on a lower portion of the bracket 302 so that the lever receiving hole 418 of the lever housing 304 and the lever fastening unit 304*a* are exposed below the bracket 302. That is, the bracket 302 has a "U" shape when viewed from below. Two fastening holes 404 are formed on a lower portion of the bracket 302. The fastening members 308 are inserted into the fastening holes 404 and push the fastening grooves 402 of the sensor housing 304 inserted through the side opening of the bracket 302.

A method of mounting the weight measuring device of the cooking apparatus according to an aspect of the present invention is described below. The weight sensor is accommodated in the sensor housing 304. The protrusions formed on the wing portions 410 of the sensor housing 304 are inserted to correspond to the positioning elements 416 of the outer bottom surface 104*b* of the cooking cavity 102 to allow the mounting position of the sensor housing 304 to be accurately determined. Thereafter, the bracket 302 is secured onto the sides of the sensor housing 304, and then the bracket 302 and the sensor housing 304 are fastened to each other by the fastening members 308. When the positions of the sensor housing 304 and the bracket 302 are determined, the bracket 302 is secured to a portion of the outer bottom surface 104*b* of the cooking cavity 102 by welding or bonding. If the positioning elements 416 formed on the outer bottom surface 104*b* of the cooking cavity 102 are shaped like through holes other than the grooves, the protrusions formed on the wing portions 410 of the sensor housing 304 are formed to have sizes so that the through holes are completely closed to prevent microwaves from leaking out of the microwave oven.

Figure 5:
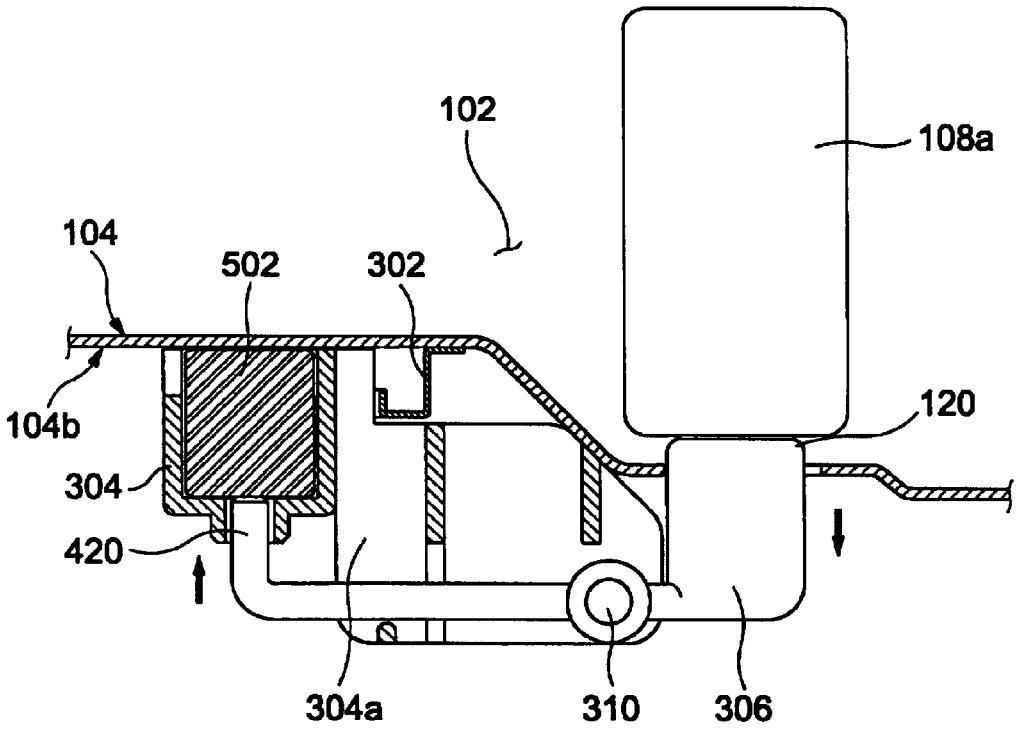
FIG. 5 is a side sectional view to show the weight measuring device of the microwave oven, shown in FIG. 3, according to an aspect of the present invention.

FIG. 5 is a side sectional view of the weight measuring device of the microwave oven shown in FIG. 3, according to an aspect of the present invention. As shown in FIG. 5, when the first end 120 of the lever 306 is pushed by the rollers 108*a* in the cooking cavity 102, the second end 420 of the lever 306 pushes the weight sensor 502 accommodated in the sensor housing 304 through the lever action. The control unit 202 shown in FIG. 2 detects an amount of pressure exerted on the weight sensor 502 by the lever 306, and determines a weight of an object laid on the tray 110.

Figure 6:
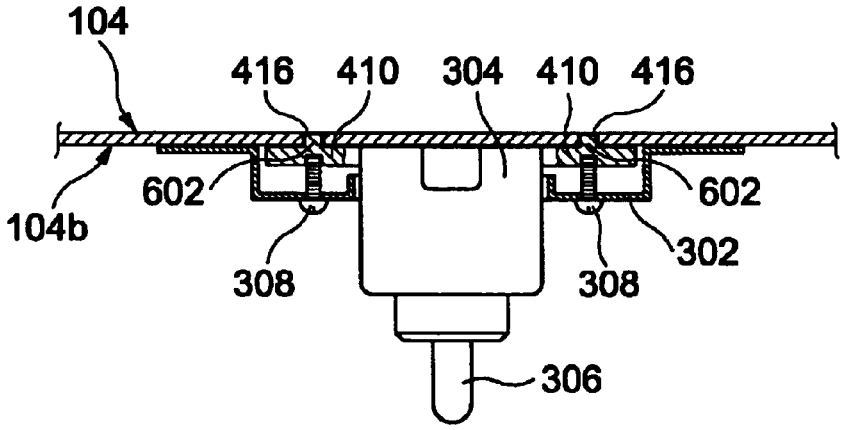
FIG. 6 is another side sectional view to show the weight measuring device of the microwave oven shown in FIG. 3, according to an aspect of the present invention.

FIG. 6 is another side sectional view of the weight measuring device of the microwave oven shown in FIG. 3, according to another aspect of the present invention. As shown in FIG. 6, the protrusions 602 formed on the wing portions 410 of the sensor housing 304 are inserted into the positioning elements 416 having through hole shapes that are formed on the outer bottom surface 104*b* of the cooking cavity 102, and, thereby, the accurate mounting position of the sensor housing 304 is determined.

As is apparent from the above description, an aspect of the present invention provides a cooking apparatus, in which the mounting structure of the weight sensor to accurately and automatically measure a weight of food is improved, thereby preventing the weight sensor from being contaminated by the food.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus, comprising:

a cooking cavity provided with a lever passing hole on an outer bottom surface of the cooking cavity;

a weight sensor disposed under the cooking cavity; and a lever extending from the weight sensor to the lever passing hole to allow a first end of the lever to be pushed by food placed in the cooking cavity and transmit pressure to the weight sensor through a lever action, a sensor housing disposed on the outer bottom surface of the cooking cavity to accommodate the weight sensor; and a lever receiving hole provided on the sensor housing to allow a second end of the lever to be brought into contact with the weight sensor accommodated in the sensor housing.

2. The cooking apparatus according to claim 1, wherein the weight sensor generates an output signal having a magnitude corresponding to a weight of the food placed in the cooking cavity.

3. The cooking apparatus according to claim 1, wherein:

the first end of the lever protrudes to an inside of the cooking cavity through the lever passing hole; and a second end of the lever is in contact with the weight sensor.

4. The cooking apparatus according to claim 1, further comprising:

a lever fastening unit integrated with the sensor housing to allow a portion of the lever between the first and second ends of the lever to be fastened to the lever fastening unit to allow a portion of the lever fastening unit to which the lever is fastened to function as a fulcrum of the lever when the lever is fastened to the lever fastening unit.

5. The cooking apparatus according to claim 4, wherein the first end of the lever protruded inside of the cooking cavity functions as a point of application of force; and the second end of the lever in contact with the weight sensor functions as a point of application of the lever action to which force is transmitted.

6. The cooking apparatus according to claim 1, wherein the sensor housing is mounted on the outer bottom surface of the cooking cavity without covering a portion of the outer bottom surface of the cooking cavity on which the lever passing hole is formed.

7. The cooking apparatus according to claim 1, wherein the sensor housing further comprises:

at least one protrusion provided on a surface that is brought into contact with the outer bottom surface of the cooking cavity; and at least one positioning element formed on the outer bottom surface of the cooking cavity to indicate a mounting position of the sensor housing by allowing the at least one protrusion of the sensor housing to be inserted into the at least one positioning element respectively.

8. The cooking apparatus according to claim 7, wherein:

two protrusions are provided on the surface of the sensor housing and two positioning elements are formed on the outer bottom surface of the cooking cavity; and spacing between the two protrusions is the same as a spacing between the two positioning elements.

9. The cooking apparatus according to claim 7, wherein the at least one positioning element comprises through holes formed by punching holes in a bottom of the cooking cavity.

10. The cooking apparatus according to claim 7, wherein the at least one protrusion is inserted into the at least one positioning element formed on the outer bottom surface of the cooking cavity, respectively, without protruding to the inside of the cooking cavity.

11. The cooking apparatus according to claim 7, further comprising:

at least one wing portion provided to the sensor housing and brought into contact with the outer bottom surface of the cooking cavity; and at least one protrusion formed on a surface of the at least one wing portion that is brought into contact with the outer bottom surface of the cooking cavity.

12. The cooking apparatus according to claim 7, wherein the at least one positioning element comprises:

a plurality of positioning elements, and a position of the plurality of positioning elements and the position of the lever passing hole form a triangle.

13. The cooking apparatus according to claim 7, wherein the at least one positioning element is formed by punching a hole on the bottom of the cooking cavity or by forming a groove on the outer bottom surface of the cooking cavity.

14. The cooking apparatus according to claim 7, wherein the at least one positioning element is spaced from the lever passing hole by a predetermined distance.

15. The cooking apparatus according to claim 1, further comprising:

an opening provided on an upper portion of the sensor housing to accommodate the weight sensor therein.

16. The cooking apparatus according to claim 15, wherein the opening provided on the upper portion of the sensor housing is brought into contact with the outer bottom surface of the cooking cavity.

17. The cooking apparatus according to claim 16, wherein the lever receiving hole provided on the sensor housing is opposite to the opening provided on the upper portion of the sensor housing.

18. The cooking apparatus according to claim 17, the second end of the lever is inserted into the lever receiving hole of the sensor housing in order to make contact with the weight sensor.

19. A cooking apparatus including a cooking cavity, comprising:

a rotatable tray located inside the cooking cavity to hold food;

a plurality of rollers brought into rolling contact with the tray and a bottom surface of the cooling cavity to rotate with the tray when the tray is rotated;

a weight sensor positioned under the cooking cavity; and a lever extending from the weight sensor to a track of the rollers to transmit pressure applied by the rollers to the weight sensor through a lever action.

20. The cooking apparatus according to claim 19, further comprising:

a control unit electrically connected to the weight sensor to determine a weight of an object laid on the tray based upon a variation of pressure measured by the weight sensor.

21. The cooking apparatus according to claim 20, wherein the control unit further comprises:

an input unit provided with a cooking mode setting button and numeral buttons to allow a user to input cooking conditions.

22. The cooking apparatus according to claim 20, further comprising:

a magnetron driving unit to drive a magnetron to generate electromagnetic waves;

a fan driving unit to drive a cooling fan;

a display driving unit to drive a display unit; and a tray driving unit to drive a tray motor to rotate the tray in the cooking cavity.

23. The cooking apparatus according to claim 19, further comprising:

a lever passing hole formed on the track of the rollers;

a first end of the lever protruding to an inside of the cooking cavity through the lever passing hole; and a second end of the lever brought into contact with the weight sensor.

24. The cooking apparatus according to claim 23, wherein the weight sensor is mounted under the cooking cavity without covering a portion of the cooking cavity where the lever passing hole is formed.

25. The cooking apparatus according to claim 19, further comprising:

a tray motor provided under the cooking cavity to rotate the tray; and a rotating shaft to connect the tray motor to the tray.

26. A cooking apparatus, comprising:

a cooking cavity provided with at least one positioning element formed on an outer bottom surface of the cooking cavity;

a weight sensor adapted to generate an electrical signal corresponding to a weight of food placed in the cooking cavity;

a sensor housing positioned under the cooking cavity, in relation to the at least one positioning element, to accommodate the weight sensor; and a bracket adapted to secure the sensor housing to the outer bottom surface of the cooking cavity.

27. The cooking apparatus according to claim 26, wherein:

the sensor housing is provided with protrusions; and the protrusions of the sensor housing are inserted into the at least one positioning element, respectively, from below the cooking cavity, but are not protruded to an inside of the cooking cavity.

28. The cooking apparatus according to claim 26, wherein the sensor housing further comprises:

at least one wing portion brought into contact with the outer bottom surface of the cooking cavity; and at least one protrusion provided on a surface of the at least one wing portion brought into contact with the outer bottom surface of the cooking cavity.

29. The cooking apparatus according to claim 26, wherein the bracket is secured to the outer bottom surface of the cooking cavity by welding or bonding.

30. The cooking apparatus according to claim 26, further comprising:

a ring-shaped roller supporting member disposed on a bottom portion of the cooking cavity; and a plurality of rollers mounted on the roller supporting member to allow the roller supporting member to be rotatable.

31. A cooking apparatus including a cooking cavity, comprising:

a lever passing hole provided on an outer bottom surface of the cooking cavity;

a weight sensor placed under the cooking cavity; and a lever protruding to an inside of the cooking cavity to transmit pressure to the weight sensor;

a sensor housing disposed on the outer bottom surface of the cooking cavity to accommodate the weight sensor; and a lever receiving hole provided on the sensor housing to allow a second end of the lever to be brought into contact with the weight sensor accommodated in the sensor housing.

* * * * *